United States Patent [19]

Wolpert et al.

[11] 3,985,415

[45] Oct. 12, 1976

[54] LOCKING PLUG AND RECEPTACLE THEREFOR

[75] Inventors: Richard W. Wolpert, Roslyn Heights; Alan T. Wolpert, Massapequa; John F. Bender, Baldwin; Harold McCormick, Roosevelt, all of N.Y.

[73] Assignee: Union Connector Company, Inc., Roosevelt, N.Y.

[22] Filed: Aug. 25, 1975

[21] Appl. No.: 607,629

[52] U.S. Cl. ..... 339/74 R

[51] Int. Cl.[2] ..... H01R 13/20

[58] Field of Search ..... 339/74, 75, 195, 196

[56] References Cited

UNITED STATES PATENTS

| | | | |
|---|---|---|---|
| 1,890,484 | 12/1932 | Allenic | 339/74 R |
| 3,267,408 | 8/1966 | Baker et al. | 339/74 R |
| 3,676,831 | 7/1972 | Bergwall | 339/74 R |

FOREIGN PATENTS OR APPLICATIONS

| | | | |
|---|---|---|---|
| 780,162 | 1/1935 | France | 339/74 R |

*Primary Examiner*—Joseph H. McGlynn
*Attorney, Agent, or Firm*—Peter L. Tailer

[57] ABSTRACT

A locking electrical plug has a casing from which there extends at least one prong containing a longitudinal slot within which there is pivotally disposed a locking hook with a hook portion projecting laterally from the slot. A spring loaded release button projects from the casing and is connected to the rear portion of the locking hook. A receptacle for the plug contains an aperture to receive the at least one prong, the aperture including a lateral enlargement to receive the projecting hook portion when the prong is inserted therein thereby locking the plug to the receptacle. Depression of the release button pivots the locking hook retracting the hook portion to unlock the plug from the receptacle.

1 Claim, 8 Drawing Figures

LOCKING PLUG AND RECEPTACLE THEREFOR

BACKGROUND OF THE INVENTION

FIELD OF THE INVENTION

This invention relates to electrical plugs and receptacles therefor that lock together to prevent the danger of accidental disconnection. The invention is particularly applicable to theater and stage lighting apparatus, but it is not limited to this field.

SUMMARY OF THE INVENTION

A plug for making an electrical connection has an insulating casing, at least one locking prong projecting from said casing, said at least one prong containing a longitudinal slot outside said casing and having a flattened area behind said slot within said casing, a locking hook disposed in said slot and having a rear end extending over said flattened area, a laterally projecting hook portion of said locking hook extending from said slot at the front of said prong, a release button connected to the rear end of said locking hook and projecting from the side of the casing opposite the slot in said prong, and spring means urging said release button in the direction opposite the slot in said prong pivoting the locking hook to extend the hook portion thereof out of the slot in the prong. A receptacle for the plug contains an aperture to receive said at least one prong, said aperture including a lateral enlargement to receive said hook portion therein thereby locking the plug to the receptacle. Depression of the release button retracts the hook portion into the slot in the prong unlocking the plug from the receptacle.

The locking plug and receptacle therefor of this invention is positive in its action, it is easy to use, it is quick and simple in its operation, and it is relatively simple and inexpensive to manufacture. It is particularly applicable to theater lighting and the like where plugs and electrical wires are trailed about and there is a constant danger of their accidental disconnection. The invention is not limited to this field.

DESCRIPTION OF THE PREFERRED EMBODIMENT

Figure 1:
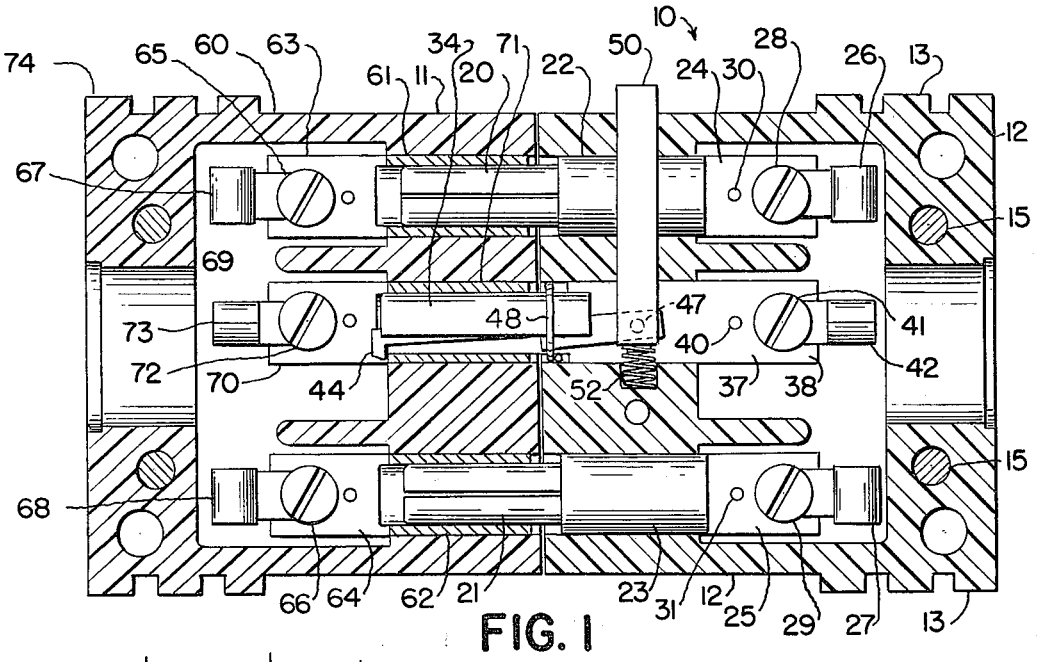
FIG. 1 is a longitudinal section through a locking plug and a receptacle therefor.

As shown in FIGS. 1–6, a locking plug for making an electrical connection is generally designated by the reference numeral 10. In FIG. 1 plug 10 is shown connected and locked to a line receptacle or female plug 11. Plug 10 has a flat insulating casing 12 with finger grips 13. A rear cover 14 is fixed to it by means of the screws 15 and a front cover 16 is fixed to it by a tubular rivet 17 or the like. A tongue 18 extends from front cover 16 under the adjacent edge of rear cover 14.

Figure 3:
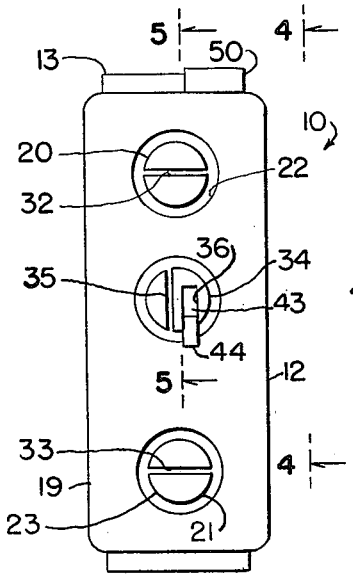
FIG. 3 is a front end view of the locking plug taken on line 3—3 of FIG. 2.
Figure 2:
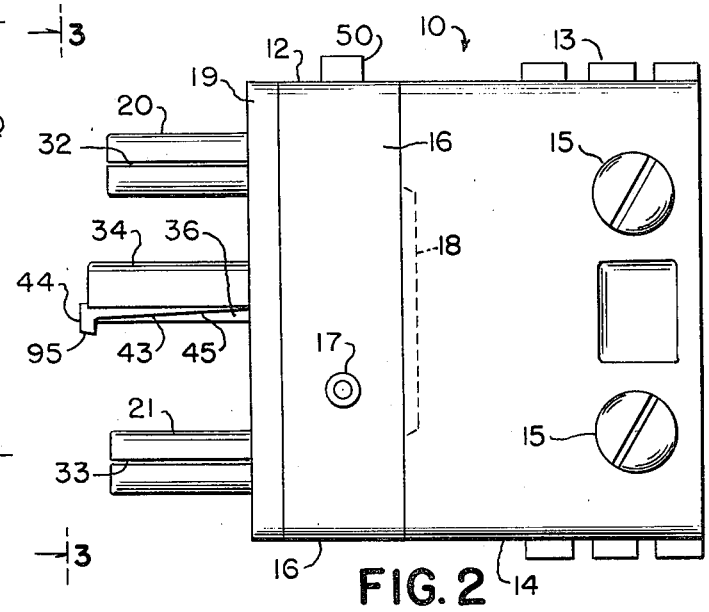
FIG. 2 is a side view of the plug of FIG. 1.
Figure 4:
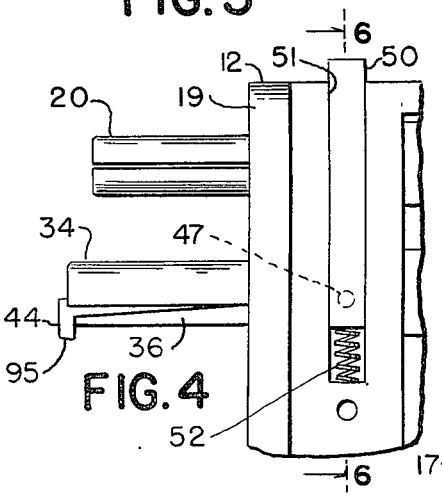
FIG. 4 is a side view of a fragment of the locking plug with its cover removed.

As shown in FIGS. 2, 3, and 4, a front flange 19 of casing 12 has the connecting prongs 20 and 21 extend from it. Enlarged shanks 22 and 23 of prongs 20 and 21 are disposed in casing 12. Shanks 22 and 23 have flat rear portions 24 and 25 to which electrical connectors 26 and 27 are attached by means of screws 28 and 29. Pins 30 and 31 extend from rear flat portions 24 and 25 into casing 12 to fix the prongs 20 and 21 in place. The prongs 20 and 21 may contain longitudinal splits 32 and 33 so they may be compressed to make a positive electrical contact.

Figure 5:
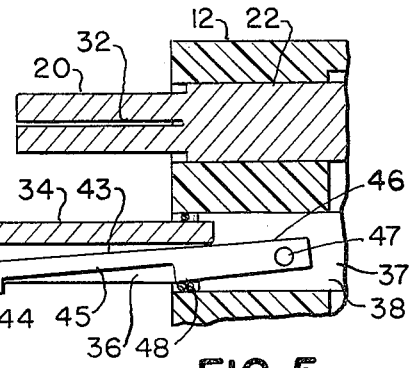
FIG. 5 is a section taken on line 5—5 of FIG. 3.

As shown in FIGS. 1 and 5, a third locking prong 34 may contain a split 35 and it does contain a wider longitudinal slot 36. The shank 37 of prong 34 has a flat rear portion 38 fixed in casing 12 by a pin 40. A screw 41 fixes a ground wire connector 42 to shank 37. A locking hook 43 has a hook projection 44 extending laterally from arm 45. A wider shank 46 of hook 43 extends over the flat rear portion 38 and has a pin 47 project upward therefrom. A circular wire spring 48 is snapped about shank 37 to help position it in casing 12 and to act as a restraint to lateral motion of the wider hook shank 46 to assist in the pivoting of hook 43 as will be described.

Figure 6:
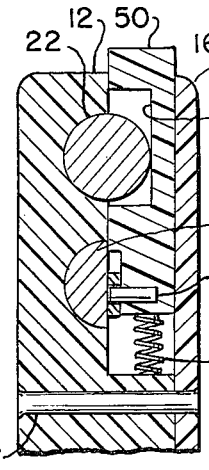
FIG. 6 is a section taken on line 6—6 of FIG. 4.

As shown in FIGS. 1, 4, and 6, a release button 50 is disposed in a slot 51 in casing 12 under the front cover 16. Pin 47 enters release button 50 to connect it thereto. A compression spring 52 urges release button 50 outwardly and thereby pivots hook 43 to extend its lateral projection 44 from slot 36. As shown in FIG. 6, a lower notch 50' is cut in release button 50 to allow it to slidably extend over shank 22 of prong 20. The front and rear covers 16 and 14 are made as separate pieces as the front cover 16 is permanently fixed to casing 12 and the rear cover 14 is removed to make electrical connections.

As may be seen in FIG. 1, a line receptacle 11 has a casing 60 with tubular prong receiving elements 61 and 62. Shanks 63 and 64 of elements 61 and 62 have flattened portions to which screws 65 and 66 attach wire connectors 67 and 68. A tubular locking prong receiving element 69 has a tubular portion 71 and a flattened shank 70. The tubular portion 71 is shorter than the prong 34 of plug 10 so that the lateral projection 44 of hook 43 will extend past the tubular portion 71 and reach over the flattened shank 70. A screw 72 fixes a suitable wire connector 73 to shank 70. Line receptacle 11 has a one piece cover (not shown) and finger grips 74. Other elements of the line receptacle and the locking plug 10 are conventional.

Figure 7:
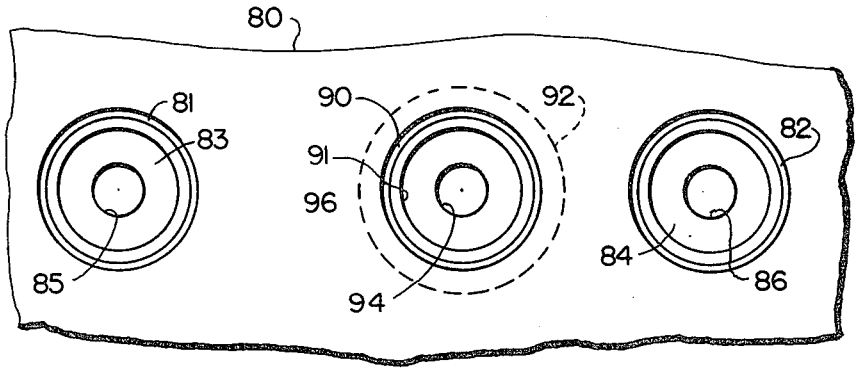
FIG. 7 is a front view of a fragment of a panel receptacle to receive the locking plug.
Figure 8:
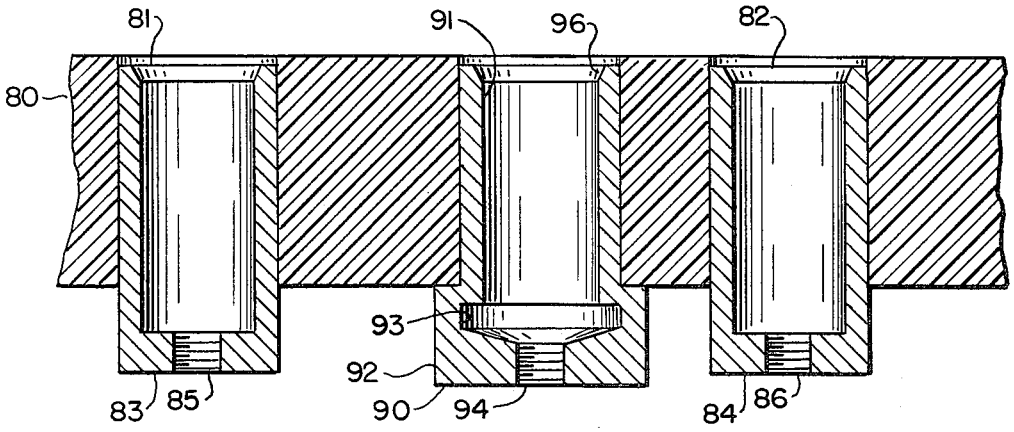
FIG. 8 is a section taken on line 8—8 of FIG. 7.

As shown in FIGS. 7 and 8, a flat panel 80 of plastic has female prong receiving elements 81 and 81 pressed or otherwise fixed therein. The elements 81 and 82 are tubular with rear walls 83 and 84 containing threaded apertures 85 and 86 to receive screws (not shown) to connect wires thereto. An element 90 has a tubular front portion 91 to receive prong 34 of plug 10 and it has an enlarged rear portion 92 within which a larger diameter laterally extending cavity or opening 93 is machined to receive the lateral projection 44 of hook 43. A threaded aperture 94 receives a screw (not shown) to connect a wire thereto. A panel 80 may be made in any configuration to receive any number of locking plugs 10.

In use, release button 50 may be depressed to retract the locking projection 44 to allow prong 34 to enter a tubular portion 71 or 91. If desired, a beveled outer edge 95 of lateral projection 44 may allow the act of insertion to pivot hook 43. This may be facilitated by providing a chamfer 96 as shown at the entrance of element 90 in FIGS. 7 and 8. Accidental pulling on an attached current carrying wire will not disconnect the locking plug 10. The release button 50 must be depressed for its removal.

While this invention has been shown and described in the best form known, it will nevertheless be understood that this is purely exemplary and that modifications may be made without departing from the spirit of the invention.

We claim:

1. A locking electrical plug and a receptacle therefor comprising, in combination, a plug having a casing containing a lateral slot and having a cover over said slot, a locking prong extending from said casing, said locking prong having a shank fixed in said casing and containing a longitudinal slot, two conducting prongs extending from said casing on each side of said locking prong, said conducting prongs having shanks and means for making electrical connections thereto within said casing, said shank of one of said conducting prongs extending across said lateral slot in said casing, a locking hook in said longitudinal slot of said locking prong, said locking hook having a lateral hook projection outside said casing and a locking hook shank terminating within said casing, a release button projecting laterally from said casing and being slidably disposed in said lateral slot of said casing, said release button containing a lower notch through which the shank of one of said conducting prongs extends limiting lateral movement of said release button, a pin connecting said release button to said shank of said locking hook, and a compression spring in said slot of said casing urging said release button outward from said casing and pivoting said locking hook to extend said lateral hook projection from said longitudinal slot in said locking prong; and a receptacle for said plug having tubular prong receiving elements to receive said prongs of said plug therein, said tubular prong receiving element receiving said locking prong containing a lateral opening to receive said lateral hook projection therein locking said plug to said receptacle.

* * * * *